US008682190B2

(12) United States Patent
Michishita

(10) Patent No.: US 8,682,190 B2
(45) Date of Patent: Mar. 25, 2014

(54) IMAGE FORMING APPARATUS

(75) Inventor: Yasuhiro Michishita, Osaka (JP)

(73) Assignee: Kyocera Mita Corporation (JP)

( * ) Notice: Subject to any disclaimer, the term of this patent is extended or adjusted under 35 U.S.C. 154(b) by 120 days.

(21) Appl. No.: 13/282,944

(22) Filed: Oct. 27, 2011

(65) Prior Publication Data

US 2012/0106993 A1 May 3, 2012

(30) Foreign Application Priority Data

Oct. 29, 2010 (JP) ..... 2010-244434

(51) Int. Cl.
*G03G 15/16* (2006.01)

(52) U.S. Cl.
USPC ..... 399/66; 399/314

(58) Field of Classification Search
USPC ..... 399/66, 314
See application file for complete search history.

(56) References Cited

U.S. PATENT DOCUMENTS

| | | | | |
|---|---|---|---|---|
| 5,410,393 | A | 4/1995 | Watanabe | |
| 6,091,913 | A * | 7/2000 | Suzuki et al. | 399/49 |
| 6,731,890 | B1 * | 5/2004 | Rakov et al. | 399/66 |
| 2002/0061203 | A1 * | 5/2002 | Akaike et al. | 399/75 |

FOREIGN PATENT DOCUMENTS

| | | |
|---|---|---|
| JP | 2000-112297 | 4/2000 |
| JP | 2003-167496 | 6/2003 |

* cited by examiner

*Primary Examiner* — Benjamin Schmitt
(74) *Attorney, Agent, or Firm* — Gerald E. Hespos; Michael J. Porco; Matthew T. Hespos

(57) ABSTRACT

An image forming apparatus includes a bias controller that controls a first application unit that applies a bias to a transfer member. The bias controller applies a reverse bias to the transfer member when a first region passes through a nip part. Then, when a second region passes through the nip part, the bias controller applies a fixed first forward bias to the transfer member. When a third region passes through the nip part, in order to implement the control the bias controller applies a variable second forward bias to the transfer member. The first forward bias is set at a predetermined value or above and increases a potential of the transfer member 46 to a level at which a toner image is transferred in the second region when the second region passes through the nip part.

6 Claims, 11 Drawing Sheets

FIG.4

| | SHEET PASSAGE TIME | | SECOND FORWARD BIAS CURRENT [$-\mu$A] |
|---|---|---|---|
| NORMAL MODE | 200mm/s | LOW HUMIDITY | 15 |
| | | NORMAL HUMIDITY | 21 |
| | | HIGH HUMIDITY | 25 |
| HALF-SPEED MODE | 100mm/s | LOW HUMIDITY | 7 |
| | | NORMAL HUMIDITY | 10 |
| | | HIGH HUMIDITY | 12 |

IMAGE FORMING APPARATUS

BACKGROUND OF THE INVENTION

1. Field of the Invention

The present invention relates to an image forming apparatus utilizing an electrophotographic system.

2. Description of the Related Art

An image forming apparatus utilizing an electrophotographic system, such as a copy machine, a printer or a fax machine, mainly consists of a photosensitive drum with a drum surface on which a toner image is formed, a developing device with a developing roller that supplies toner to the drum surface of the photosensitive drum to form the toner image on the drum surface, and a transfer roller that forms a nip part between the transfer roller and the drum surface and transfers the toner image on the drum surface to a sheet.

In this type of image forming apparatus, a developing bias is applied to the developing roller and a drum bias to the drum surface at the time of image formation, and consequently a potential difference is generated between the developing roller and the drum surface. This potential difference allows the toner to move from a circumferential surface of the developing roller onto the drum surface, forming the toner image on the drum surface. Also, application of a transfer bias to the transfer roller generates a potential difference between the drum surface and the transfer roller. Due to this potential difference, the toner image on the drum surface is attracted to the transfer roller and transferred onto the sheet passing through the nip part.

In the image forming apparatus with the configuration described above, the transfer of the toner image depends on a rise of the transfer bias. A rise of the transfer bias fluctuates according to various factors, such as, for example, the rising performance of the transfer bias in a high-voltage power source, as well as a hygrothermal environment. When the transfer bias rises slowly, a leading end part of the sheet is not applied with a sufficient level of transfer bias when passing through the nip part. As a result, the toner image is not transferred adequately to the leading end part of the sheet, causing an image defect in the leading end part of the sheet.

In a technology for inhibiting an image defect that is used in a conventional image forming apparatus, a low level of first transfer bias current is applied once to a leading end part of a sheet passing through a nip part, and then a second transfer bias current higher than the first transfer bias current is applied to a downstream side section of the sheet when the downstream side section from the leading end part passes through the nip part. Accordingly, transfer bias rising time can be shortened, inhibiting the generation of an image defect.

However, in the image forming apparatus using the conventional technology described above, although low, the first transfer bias current is applied to the leading end part of the sheet, to charge the leading end part of the sheet. Because the drum surface of the photosensitive drum is applied with a drum bias current having a polarity opposite to that of the first transfer bias current, the leading end part of the sheet is electrostatically attached to the drum surface. As a result, the separability of the sheet from the drum surface drops, causing a paper jam.

SUMMARY OF THE INVENTION

The present invention was contrived in view of the circumstances described above, and an object thereof is to provide an image forming apparatus that is capable of inhibiting an image defect caused at the time of image transfer, and improving the separability of a sheet from a drum surface.

In order to achieve the object, according to the present invention, an image forming apparatus, comprises:

a photosensitive drum that has a drum surface on which a toner image is formed;

a transfer member that forms, with the drum surface, a nip part through which a sheet passes while conveyed, and sequentially transfers onto the sheet in the nip part the toner image on the drum surface from a conveying direction leading end side of the sheet;

a first application unit that selectively applies a fixed first forward bias, a variable second forward bias, and a reverse bias having a polarity opposite to those of the first forward bias and the second forward bias, to the transfer member;

a second application unit that applies a drum bias having a polarity opposite to those of the first and second forward biases to the drum surface; and a bias controller that controls the first application unit and the second application unit, and has a state acquiring unit for acquiring predetermined information and a setting unit for setting the second forward bias in accordance with the state information, wherein the bias controller, while controlling the second application unit to apply the drum bias to the drum surface, first, controls the first application unit to apply the reverse bias or no bias to the transfer member, when a first region, which is located at a conveying direction farthest leading end of the sheet and to which the toner image is not transferred, passes through the nip part, then controls the first application unit to apply the first forward bias to the transfer member when a conveying direction leading end part of a second region begins to pass through the nip part, this second region being a region which is located on a rear end side of the first region in a conveying direction of the sheet and to which the toner image is transferred, and then controls the first application unit to apply the second forward bias to the transfer member when a third region, which is located on a further rear end side than the second region in the conveying direction of the sheet and to which the toner image is transferred, passes through the nip part, and wherein the first forward bias is set at a predetermined value or above, and increases a potential of the transfer member to a level at which the toner image is transferred in the second region when the second region passes through the nip part.

According to an image forming apparatus of the present invention, as mentioned above, a bias controller applies a reverse bias or no biases to a transfer member when a first region of a sheet passes through a nip part. The reverse bias applied to the transfer member has the same polarity as a drum bias applied to a drum surface. Therefore, even when the first region is charged to the same polarity as that of the reverse bias, the first region of the sheet is prevented from passing through the nip part while electrostatically attached to the drum surface. Consequently, the separability of the sheet from the drum surface can be improved.

The bias controller also applies a first forward bias to the transfer member when a second region of the sheet passes through the nip part. The first forward bias, which is a fixed bias, is set regardless of state information required for setting a second forward bias, and is at a level for increasing a potential of the transfer member to a point where a toner image is transferred to the second region when the second region passes through the nip part. In other words, the first forward bias is not to be corrected in accordance with, for example, the state information such as a hygrothermal environment, but is to be fixed. Therefore, the time required for the potential of the transfer member to reach a predetermined level is made constant. The level that the potential of the transfer member reaches within this time period is the level at which the toner image is transferred to the second region of the sheet. Therefore, in the image forming apparatus according to the present invention, the first forward bias is set so as to inhibit fluctuations of rising times of the first forward bias. This can prevent the generation of an image defect that is caused due to the fact that the toner image is not transferred adequately to the second region of the sheet.

These and other objects, features and advantages of the present invention will become apparent upon reading of the following detailed description along with the accompanied drawings.

BRIEF DESCRIPTION OF THE DRAWINGS

FIG. 4 is a diagram showing a set value of a second forward bias current, which is set by a setting unit in accordance with humidity, one of state information pieces;

FIG. 9 shows an experiment for confirming whether an image defect is generated or not when a strip-shaped toner image extending along a conveying direction of a sheet is formed on the sheet, wherein

DESCRIPTION OF THE PREFERRED EMBODIMENTS

Embodiments of the present invention are described hereinafter in detail with reference to the drawings. In the following description, a monochrome printer is described as an image forming apparatus of an embodiment of the present invention. However, the present invention is not limited thereto and can be applied to copy machines, fax machines, combined machines with these functions, or other image forming apparatuses.

Figure 1:
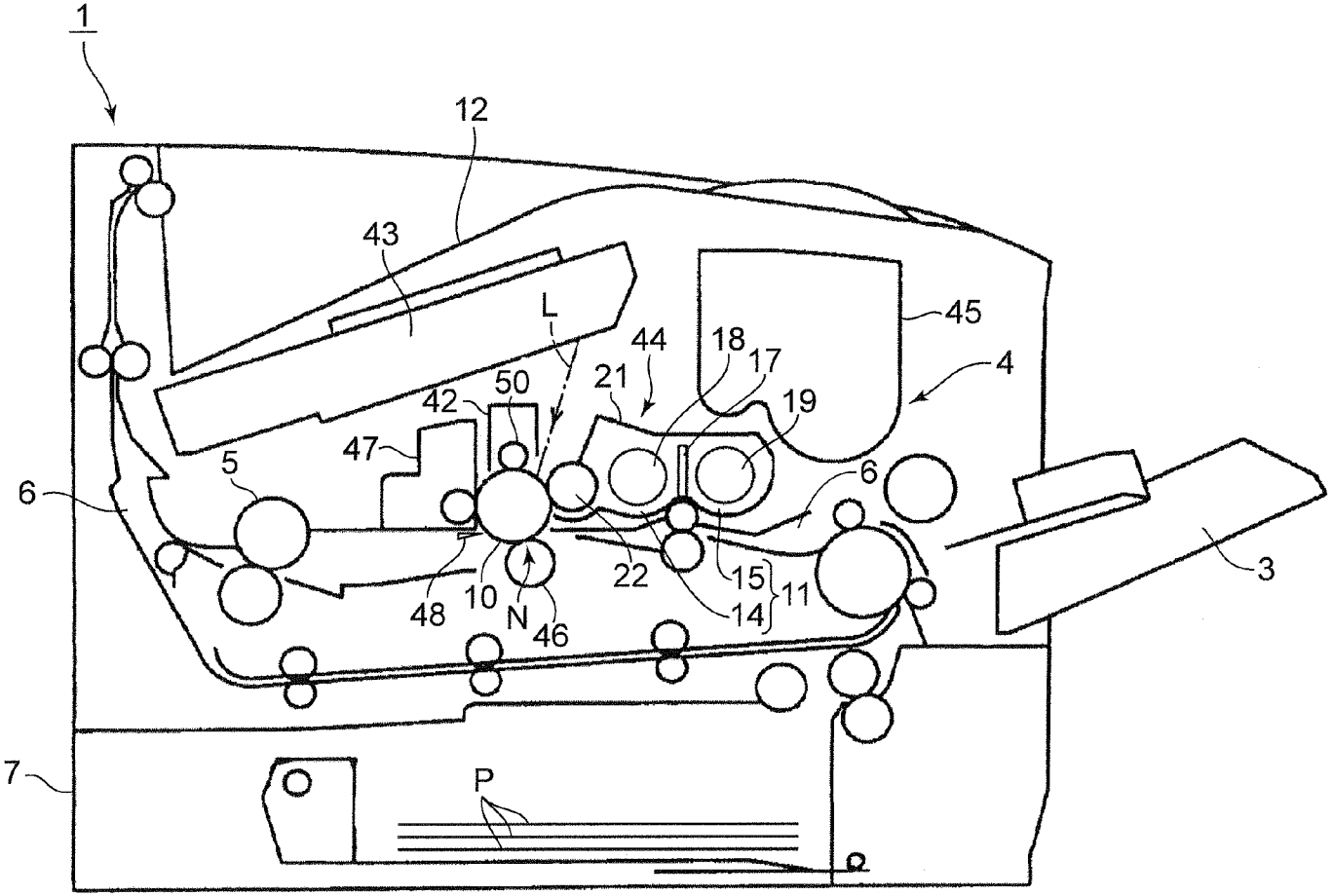
FIG. 1 is a diagram schematically showing an internal structure of an image forming apparatus.
Figure 2:
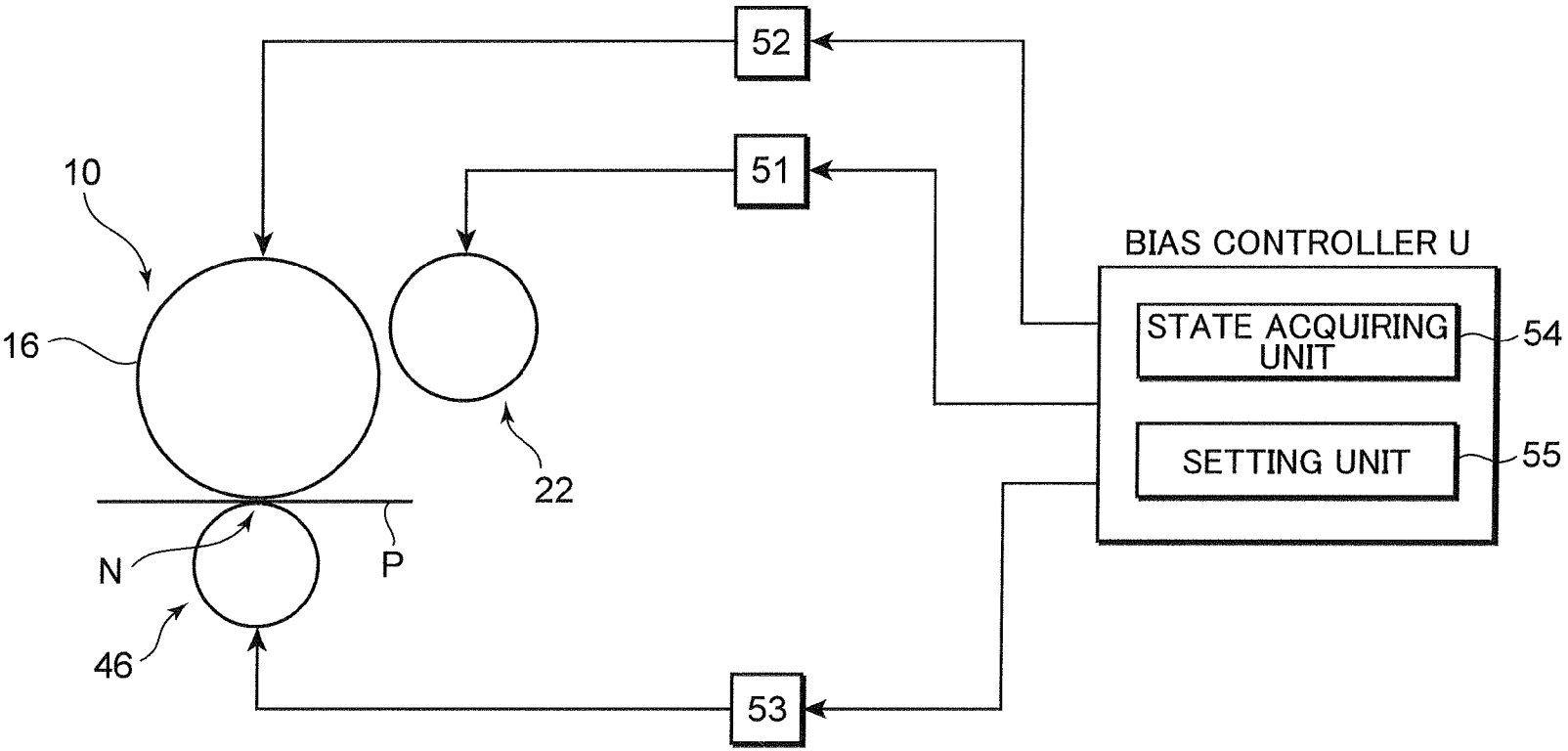
FIG. 2 is a schematic diagram showing a bias control system of the image forming apparatus.

FIG. 1 is a diagram schematically showing an internal structure of an image forming apparatus 1. FIG. 2 is a schematic diagram showing a bias control system of the image forming apparatus 1. The image forming apparatus 1 includes an image forming unit 4 for forming a toner image on a sheet P on the basis of image data from the outside (e.g., a personal computer), a fixing unit 5 for heating the toner image formed on the sheet P to fix the toner image to the sheet P, a sheet feeding cassette 7 for storing the sheet P, a catch tray 12 to which the sheet P is discharged, a conveying path 6 for conveying the sheet P from the sheet feeding cassette 7 to the catch tray 12 via the image forming unit 4 and the fixing unit 5, a manual tray 3 provided on a right-side surface of the image forming apparatus 1 in FIG. 1, and an operation unit (not shown) in which a plurality of menu setting keys and the like for setting various menus are disposed.

The image forming unit 4 includes a photosensitive drum 10, a charger 42, an exposure device 43, a developing device 44, a toner cartridge 45, a transfer roller (transfer member) 46, a separating click (separating member) 48, and a toner remover 47. As viewed from a rotation direction of the photosensitive drum 10 (a clockwise direction in FIG. 1), the charger 42, the developing device 44, the transfer roller 46, the separating click 48 and the toner remover 47 are disposed in this order along a circumferential direction of the photosensitive drum 10. The exposure device 43 is disposed above the charger 42.

An OPC drum (organic photosensitive drum), for example, is used as the photosensitive drum 10. The OPC drum has an organic photosensitive layer made of an organic photosensitive material on a drum surface 16. A charge generating agent and charge transport agent are dispersed in the organic photosensitive layer. The organic photosensitive layer can be charged both positively and negatively. Note that a photosensitive drum using an amorphous silicon (a-Si) material may be used as the photosensitive drum 10.

The charger 42 has a charging roller 50. The charging roller 50 is of a contact charging type where a circumferential surface thereof comes into substantially point contact with the drum surface 16. The charging roller 50 uniformly charges a surface potential of the drum surface 16 by applying a drum bias to the drum surface 16, the drum bias being obtained by superposing DC voltage and AC voltage. The drum bias is a positive bias in the present embodiment. The charger 42 is connected to a drum application unit (second application unit) 52, and the drum bias is applied to the drum surface 16 by the drum application unit 52.

The exposure device 43 has a polygon mirror (not shown), which guides a laser beam L based on the image data input from the outside PC (personal computer), to the drum surface 16 of the photosensitive drum 10. The polygon mirror scans the drum surface 16 of the photosensitive drum 10 by using the laser beam L, while being rotated by a predetermined drive source, and forms an electrostatic latent image on the drum surface 16.

The developing device 44 supplies toner to the electrostatic latent image to form a toner image on the drum surface 16. In the present embodiment, the developing device 44 uses one-component developer that does not include carrier but only magnetic toner. As shown in FIG. 1, the charging device 44 includes, as basic components thereof, a developer container 21 defining an internal space of the developing device 44, a developer storage unit 11 formed on bottom wall of the developer container 21, and a developing roller 22 disposed in an opening of the developer container 21. The developing device 44 may use two-component developer that includes both magnetic carrier and non-magnetic toner.

The developer storage unit 11 is configured by two developer storage chambers 14, that are adjacent to each other and extend in a longitudinal direction of the developing device 44 (a vertical direction with respect to the paper plane of FIG. 1). The developer storage chambers 14, are partitioned in the longitudinal direction by a partition plate 17 made from, for example, aluminum or other metal, but are communicated with each other at either end parts of the developing device 44 in the longitudinal direction.

Screw feeders 18, 19 for agitating and conveying the developer while rotating are rotatably installed in the developer storage chambers 14, 15, respectively. The screw feeders 18, 19 are set such that conveying directions thereof are opposite to each other. Therefore, the developer is agitated and conveyed between the developer storage chamber 14 and the developer storage chamber 15. This agitation charges the magnetic toner. In the present embodiment the toner has a positive charge polarity.

The developing roller 22 is disposed facing the drum surface 16 of the photosensitive drum 10 such that a gap of 0.2 to 0.4 mm is formed between an outer circumferential surface of the developing roller 22 and the drum surface 16. A so-called pumping pole is disposed inside the developing roller 22, and the toner inside the developer storage chamber 14 is caused to adhere magnetically to the outer circumferential surface of the developing roller 22 by magnetic force of the pumping pole.

The toner on the outer circumferential surface of the developing roller 22 is carried toward the drum surface 16 of the photosensitive drum 10 as the developing roller 22 rotates, and then adheres to the electrostatic latent image on the drum surface 16 of the photosensitive drum 10 in accordance with a difference in potential between a developing bias applied to the developing roller 22 and the drum bias applied to the drum surface 16 of the photosensitive drum 10. As a result, the toner image is formed on the drum surface 16. In the present embodiment, the developing bias is a positive bias. It is preferred that the potential difference between the developing roller 22 and the drum surface 16 be 100 V or above, in order to form a favorable toner image. The developing roller 22 is connected to a developing application unit 51, and the developing bias is applied to the developing roller 22 by the developing application unit 51.

The transfer roller 46 is a member for transferring the toner image, formed on the drum surface 16 of the photosensitive drum 10, to the sheet P. The transfer roller 46 is a roller member in which a sponge rubber layer is formed on a cored bar made of SUS, Fe or the like so that the sponge rubber layer has a resistance of 1×106 to 1×1010[Ω] due to carbon or ion-conductive filler. The transfer roller 46 extends parallel to the photosensitive drum 10 and is disposed in contact with the drum surface 16 in the conveying path 6 such that a nip part N is formed between the transfer roller 46 and the drum surface 16. The sheet P passes through the nip part N.

A transfer application unit (first application unit) 53 is connected to the transfer roller 46, and transfer biases are applied to the transfer roller 46 by the transfer application unit 53. Specifically, a first forward bias current (first forward bias), second forward bias current (second forward bias), and reverse bias current (reverse bias) having a polarity opposite to those of the first forward bias current and the second forward bias current, are selectively applied to the transfer roller 46. In the present embodiment, the first forward bias current and the second forward bias current are negative biases, whereas the reverse bias current is a positive bias. Therefore, the first forward bias current and the second forward bias current applied to the transfer roller 46 are biases having polarities opposite to the drum bias (positive bias) applied to the drum surface 16. As described hereinafter, the first forward bias current is a fixed bias and the second forward bias current is a variable bias.

When the drum bias is applied to the drum surface 16 and the first forward bias current and the second forward bias current to the transfer roller 46 while the toner image is formed on the drum surface 16, the toner of the toner image that is charged positively becomes attracted to the transfer roller 46 by the potential difference between the drum surface 16 and the transfer roller 46. As a result, the toner image is transferred to the sheet P passing through the nip part N.

The separating click 48 comes into contact with the sheet P when the sheet P passes through the nip part N while attached electrostatically to the drum surface 16, to separate the sheet P from the drum surface 16. As viewed from a conveying direction in which the sheet P passes through the nip part N while conveyed, the separating click 48 is disposed so as to face the drum surface 16 at a downstream position from the nip part N, with a predetermined gap therebetween.

The toner remover 47 removes and recovers the toner that remains on the drum surface 16 after the toner image is transferred to the sheet P.

The sheet P that passes through the nip part N is conveyed to the fixing unit 5 through the conveying path 6. The fixing unit 5 heats and fixes the toner image onto the sheet P. The sheet P obtained after this fixing process is conveyed to the catch tray 12 via the conveying path 6.

The image forming apparatus 1 further includes a bias controller U, as shown in FIG. 2. The bias controller U controls the drum application unit 52, the developing application unit 51 and the transfer application unit 53. The bias controller U executes an image formation mode for forming a toner image on the drum surface 16 and transferring the toner image to the sheet P, by appropriately controlling the drum application unit 52, the developing application unit 51 and the transfer application unit 53.

The bias controller U controls the transfer application unit, depending on a transfer region on the sheet P to which the toner is transferred, and selectively applies the first forward bias current, the second forward bias current and the reverse bias current to this region.

Figure 3:
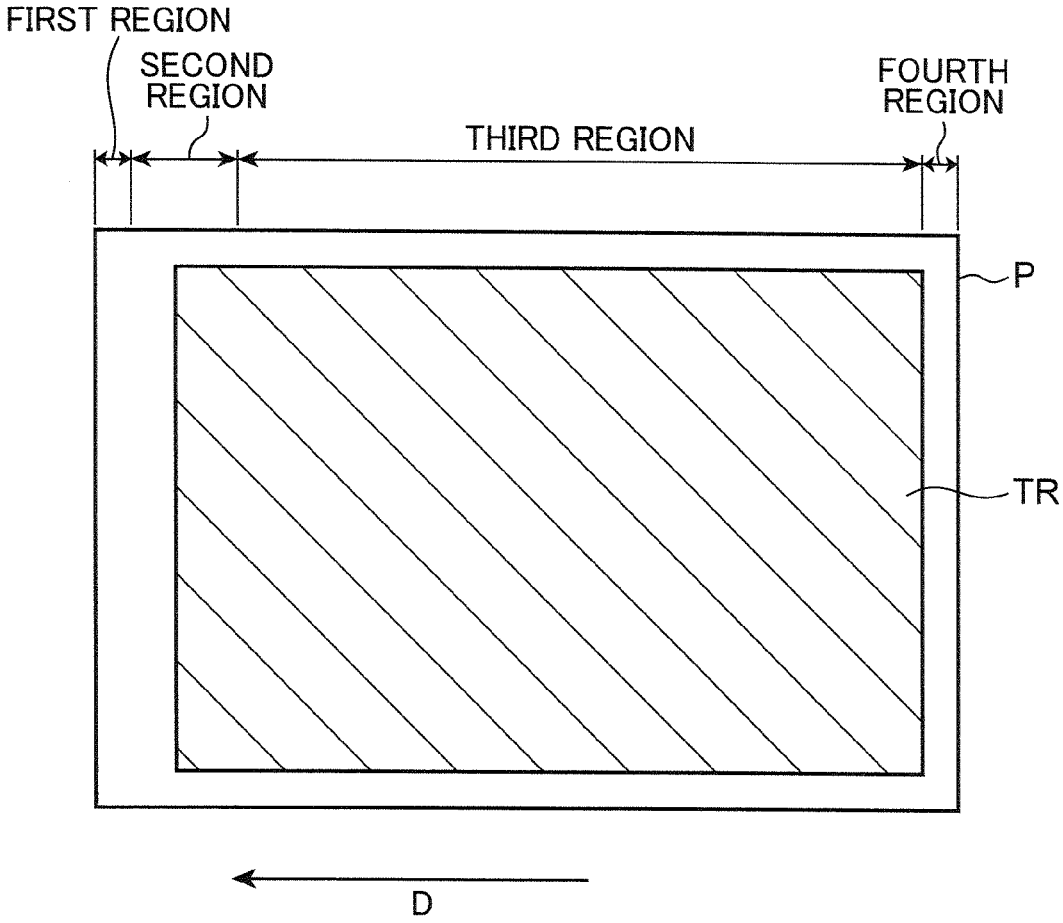
FIG. 3 is a planar view of a sheet, showing regions to which transfer biases are selectively applied.

The selective application of the transfer biases by the bias controller U is described with reference to FIG. 3. FIG. 3 is a planar view of the sheet P, showing a region to which the transfer biases are selectively applied. Reference mark D shown in FIG. 3 represents the conveying direction in which the sheet P passes through the nip part N while conveyed. Reference mark TR represents the transfer region to which the toner image is transferred.

The sheet P includes a first region, a second region, a third region and a fourth region arranged along the conveying direction D. The first region, located at the conveying direction farthest leading end of the sheet P, is a region to which the toner image is not transferred. The first region covers an edge section of the sheet P. The second region, located on the rear end side from the first region in the conveying direction, is a region, to a part of which the toner is transferred first. The second region covers a conveying direction leading end of the sheet P. The third region, located on the rear end side from the second region in the conveying direction, is a region to which the toner image is transferred subsequently to the second region. The fourth region, located on the rear end side from the third region in the conveying direction, is a region to which the toner image is not transferred. The fourth region covers an edge section opposite from the edge section covered by the first region. The transfer region TR is configured by a part of the second region and the third region.

The bias controller U controls the transfer application unit 53 so that the reverse bias current is not applied to the first region or so that no biases are applied, when the first region passes through the nip part N. The bias controller U also controls the transfer application unit 53 to apply the first forward bias current to the second region, when the second region passes through the nip part N.

The bias controller U further controls the transfer application unit 53 to apply the second forward bias current to the third region, when the third region passes through the nip part N. The bias controller U includes a state acquiring unit 54 and a setting unit 55, as shown in FIG. 2, for setting the second forward bias current.

The state acquiring unit 54 acquires state information required for setting the second forward bias current. The state information includes, for example, a hygrothermal environment and the type of the sheet P. The state acquiring unit 54 acquires more than one state information pieces.

The setting unit 55 sets the second forward bias current in accordance with the state information acquired by the state acquiring unit 54. FIG. 4 is a diagram showing a set value of the second forward bias current, which is set by the setting unit 55 in accordance with humidity, one of the state information pieces. As shown in the diagram, in a normal mode in which the speed of the sheet P passing through the nip part N is 200 mm/s, the setting unit 55 sets the second forward bias current at −15 μA when the humidity is low, sets the second forward bias current at −21 μA when the humidity is normal, and sets the second forward bias current at −25 μA when the humidity is high. In a half-speed mode in which the speed of the sheet P passing through the nip part N is 100 mm/s, the setting unit 55 sets the second forward bias current at −7 μA when the humidity is low, sets the second forward bias current at −10 μA when the humidity is normal, and sets the second forward bias current at −12 μA when the humidity is high. Low humidity means when the humidity is 20% or lower, and normal humidity means when the humidity is 50 to 60%. High humidity means when the humidity is 80% or higher. The half-speed mode is selected when forming a high-quality toner image or when forming a toner image on a cardboard.

In this manner, the second forward bias current applied to the third region of the sheet P is changed depending on the state information. The first forward bias current applied to the second region of the sheet P, on the other hand, is fixed at a predetermined value.

Specifically, the first forward bias current is set regardless of the state information required for setting the second forward bias, and is a bias that increases the potential of the transfer roller 46 to a level at which the toner image is transferred to the second region when the second region of the sheet P passes through the nip part N. In other words, the first forward bias current is not to be corrected in accordance with the state information (hygrothermal environment or the like), but is to be fixed. Therefore, the time required for the potential of the transfer roller 46 to reach a predetermined level when the first forward bias current is applied to the transfer roller 46 upon the passage of the conveying direction leading end part of the second region of the sheet P through the nip part N, is made constant. The level that the potential of the transfer roller 46 reaches within this time period is the level at which the toner image is transferred.

Figure 5:
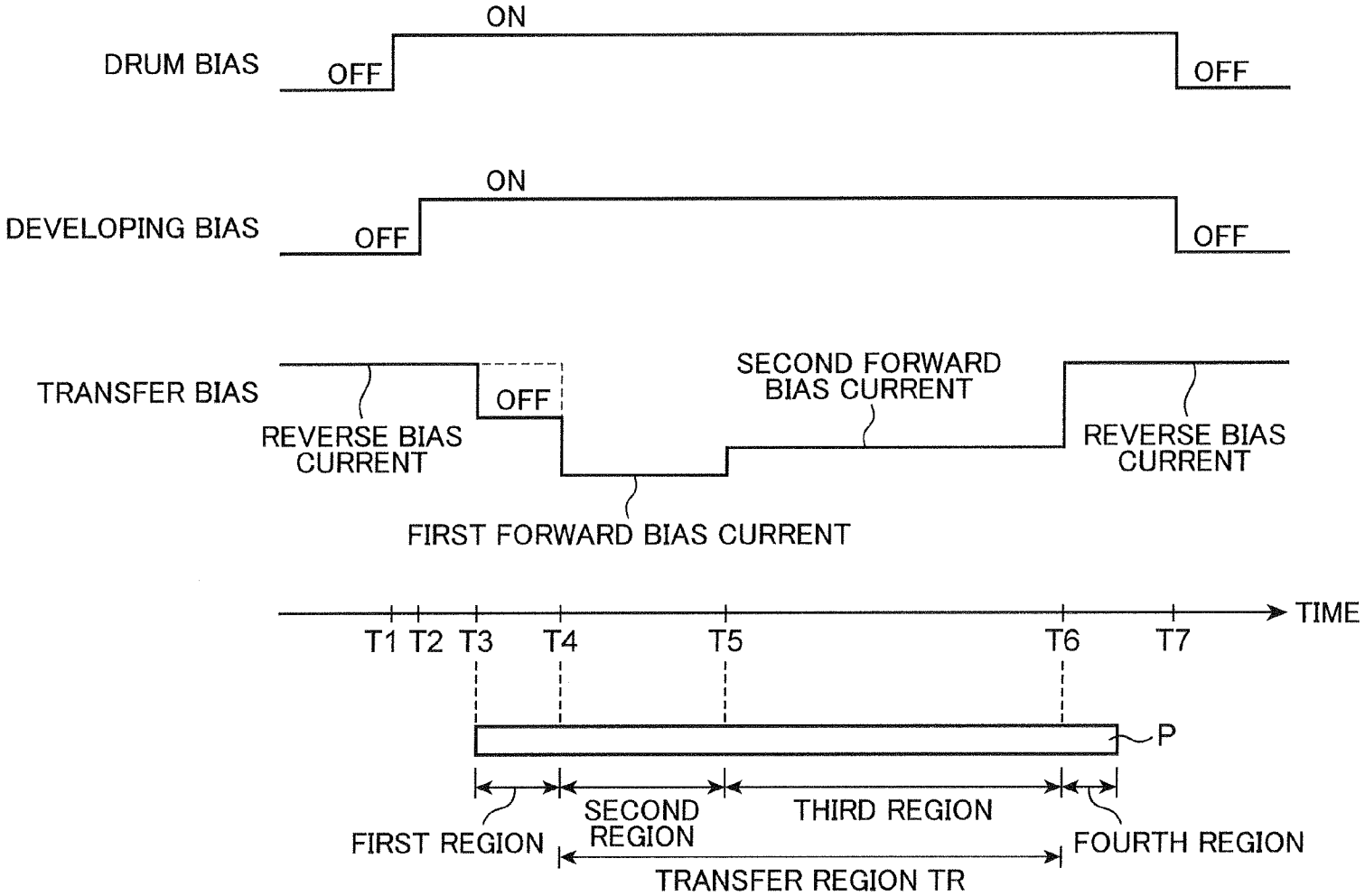
FIG. 5 is a diagram showing sequence control performed on a drum bias applied to a drum surface of a photosensitive drum, a developing bias applied to a developing roller of a developing device, and transfer biases applied to a transfer roller.

Next, an example of sequence control in which the bias controller U applies the biases in the image formation mode is described with reference to FIG. 5. The example of sequence control shown in FIG. 5 is performed when the half-speed mode is selected and the humidity is normal. When executing the image formation mode (a period between a time point T1 and a time point T7 in FIG. 5), the bias controller U controls the drum application unit 52 at the time point T1, to apply the drum bias to the drum surface 16. The bias controller U then controls the developing application unit 51 at the time point T2, to apply the developing bias to the developing roller. As a result, a potential difference is generated between the developing roller 22 and the drum surface 16, whereby the toner on the developing roller 22 adheres to the electrostatic latent image on the drum surface 16, forming a toner image.

The bias controller U controls the transfer application unit 53 to apply the reverse bias current to the transfer roller 46 prior to the execution of the image formation mode. However, after application state of the developing bias at the time point T2, the bias controller U controls the transfer application unit 53 at a time point T3, which is when the first region of the sheet P passes through the nip part N (i.e., the conveying direction leading end of the first region enters the nip part N), and stops the application of the bias to the transfer roller 46 (OFF) or holds application of the reverse bias current, as shown by a dashed line. The reverse bias current is set at +1 μA. The first region is a region in the sheet P where no forward biases are applied from the transfer roller 46 and, therefore, the toner image is not transferred, as described above.

The bias controller U then controls the transfer application unit 53 at a time point T4, which is when the conveying direction leading end part of the second region of the sheet P begins to pass through the nip part N, and applies the first forward bias current to the transfer roller 46.

In order to adequately transfer the toner image to perform appropriate image formation in the second region, the potential of the transfer roller 46 needs to be increased to a predetermined level until the second region enters the nip part N and passes therethrough. In the present embodiment, by setting the first forward bias current at −15 μA, the potential of the transfer roller 46 can be increased, within 20 msec, to −1 through −1.5 KV, which is required for transferring the toner image. This creates, between the transfer roller 46 and the drum surface 16, a certain level of potential difference required for the transfer, within 20 msec. As a result, the toner image can be transferred reliably in the second region. The first forward bias current is fixed, as described above.

The bias controller U then controls the transfer application unit 53 at a time point T5, after a lapse of a predetermined time period since the time point T4, which is when the third region of the sheet P passes through the nip part N, and applies the second forward bias current to the transfer roller 46. The second forward bias current is set at −10 μA (FIG. 4) by the setting unit 55 of the bias controller U. Because the second forward bias current is appropriately set in accordance with the humidity, a certain level of potential difference required for the transfer is generated between the transfer roller 46 and the drum surface 16. As a result, the toner image is transferred reliably in the third region of the sheet P.

Subsequently, the bias controller U controls the transfer application unit 53 at a time point T6, which is when the fourth region passes through the nip part N, and applies the reverse bias current to the transfer roller 46. Finally, the bias controller U controls the drum application unit 52 at a time point T7 to stop the application of the drum bias to the drum surface 16 (OFF), and controls the developing application unit 51 to stop the application of the developing device to the developing roller 22 (OFF). As a result, the transfer operation performed on the single sheet P is ended, and the image formation mode corresponding to the half-speed mode is ended.

Figure 6:
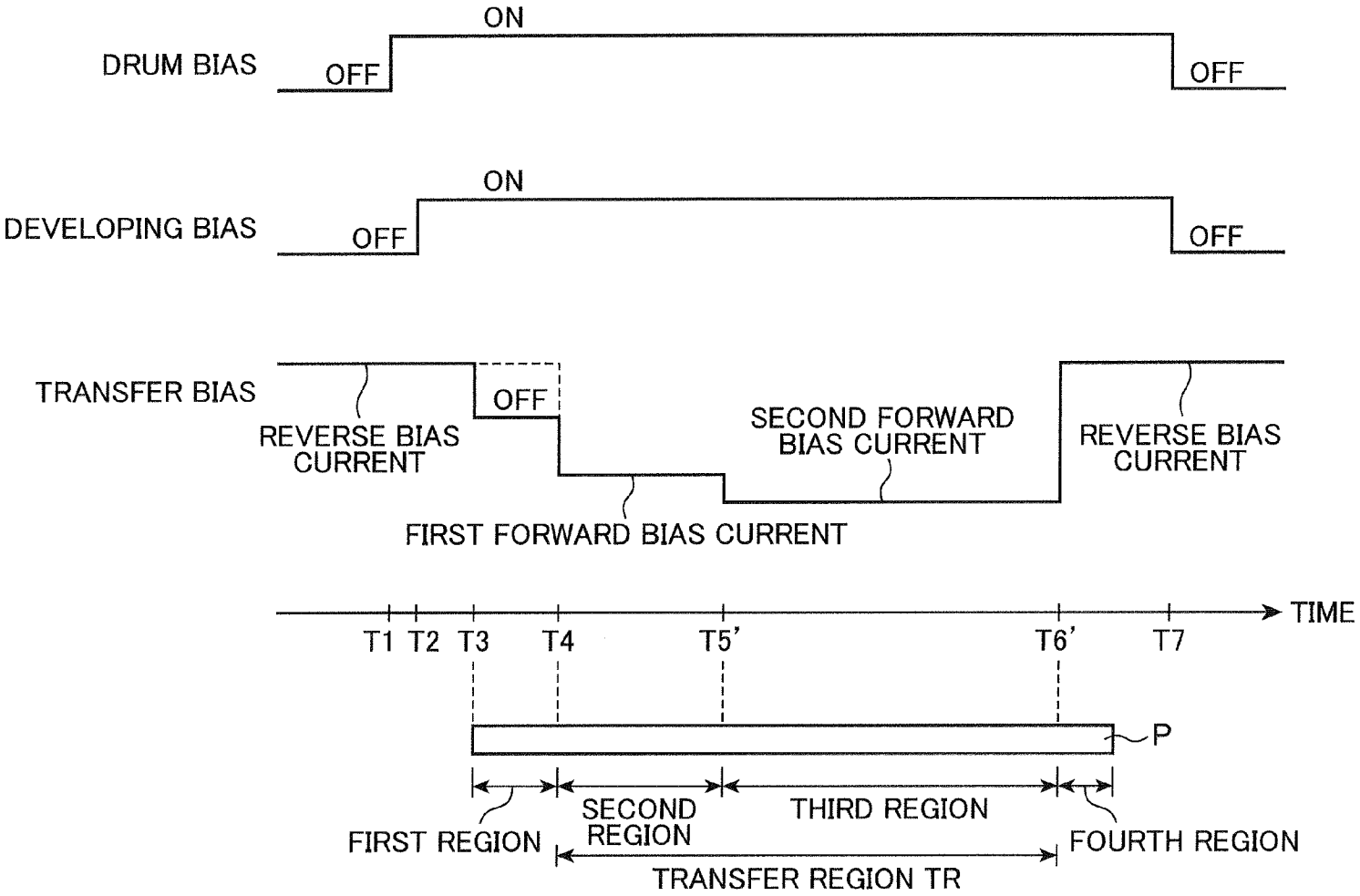
FIG. 6 is a diagram showing another sequence control performed on the drum bias applied to the drum surface of the photosensitive drum, the developing bias applied to the developing roller of the developing device, and the transfer biases applied to the transfer roller.

Next, another example of sequence control in which the bias controller U applies the biases in the image formation mode is described with reference to FIG. 6. The example of sequence control shown in FIG. 6 is performed when the normal mode is selected and the humidity is normal. In the example of sequence control shown in FIG. 6, the bias control performed in a period between the time point T1 and the time point T4 is same as the example of sequence control shown in FIG. 5, thus the explanation on this period is omitted.

The bias controller U controls the transfer application unit 53 at a time point T5', which is when the third region of the sheet P passes through the nip part N, and applies the second forward bias current to the transfer roller 46. The second forward bias current is set at −21 μA (see FIG. 4) by the setting unit 55 of the bias controller U. Because the second forward bias current is set appropriately in accordance with the humidity, a certain level of potential difference required for the transfer is generated between the transfer roller 46 and the drum surface 16. As a result, the toner image can be transferred reliably in the third region of the sheet P.

Then, the bias controller U controls the transfer application unit 53 at a time point T6', which is when the fourth region passes through the nip part N, to apply the reverse bias current to the transfer roller 46. Finally, as in the example of sequence control shown in FIG. 5, at the time point T7, the bias controller U controls the drum application unit 52 to stop the application of the drum bias to the drum surface 16 (OFF), and controls the developing application unit 51 to stop the application of the developing bias to the developing roller 22 (OFF). As a result, the transfer operation performed on the single sheet P is ended, and the image formation mode corresponding to the normal mode is ended.

In the sequence control shown in FIG. 6, because the value of the second forward bias current is greater than that of the first forward bias current, the application of the first forward bias current may be omitted, and the second forward bias current may be applied starting from the time point T4.

According to the image forming apparatus 1 of the present embodiment described above, the bias controller U applies the reverse current to the transfer roller 46 or does not apply any bias to the transfer roller 46, when the first region of the sheet P passes through the nip part N (time point T3), as in the examples of sequence control shown in FIGS. 5 and 6. The reverse bias current applied to the transfer roller 46 has the same polarity as the drum bias applied to the drum surface 16. Therefore, even when the first region is charged to the polarity same as that of the reverse bias current, the first region of the sheet P can be prevented from passing through the nip part N while attached electrostatically to the drum surface 16.

Figure 7:
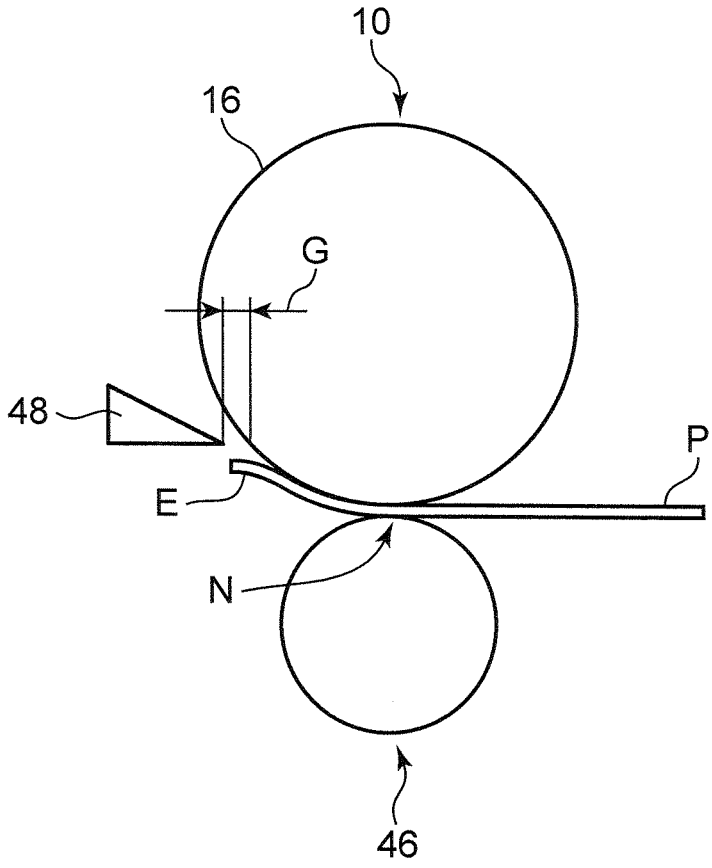
FIG. 7 is a schematic diagram for explaining operations of a separating click.

In other words, a first region E passes through the nip part N while away from the drum surface 16, as shown in FIG. 7. Therefore, even when the second region or the third region of the sheet P passes through the nip part N while attached to the drum surface 16, the first region E reliably comes into contact with the separating click 48 disposed facing the drum surface 16 with a predetermined gap G therebetween, because the first region E is separated from the drum surface 16. Consequently, the sheet P is peeled off of the drum surface 16. The application of the reverse bias current to the first region E or application of no biases can improve the separability of the sheet P from the drum surface 16.

Because the first region E is separated from the drum surface 16 after passing through the nip part N, the gap G between the separating click 48 and the drum surface 16 can be set to be larger than that of the prior art. Accordingly, the dimension tolerance or mounting tolerance of the separating click 48 can be increased.

In addition, according to the image forming apparatus 1 of the present embodiment, the first forward bias current is not always set in accordance with the state information (hygrothermal environment or the like) required for setting the second forward bias current, but is set at a predetermined value or greater. Thus, when the first forward bias current is applied to the transfer roller 46 as the conveying direction leading end part of the second region of the sheet P begins to pass through the nip part N, the time required for the potential of the transfer roller 46 to reach a predetermined level is constantly stable.

Specifically, in the present embodiment, setting the first forward bias current at −15 μA or above can increase, within 50 msec, the potential of the transfer roller 46 to −1 through −1.5 KV required for the transfer. As a result, a certain level of potential difference required for the transfer can be generated between the transfer roller 46 and the drum surface 16 during a period of time between when the second region of the sheet P begins to pass through the nip part N and a predetermined time point.

In other words, setting the first forward bias current at −15 μA or above prevents rising times of the first forward bias current from fluctuating. The rising times of the first forward bias current greatly vary depending on whether the first forward bias current is set at a high bias level or a low bias level.

Figure 8A:
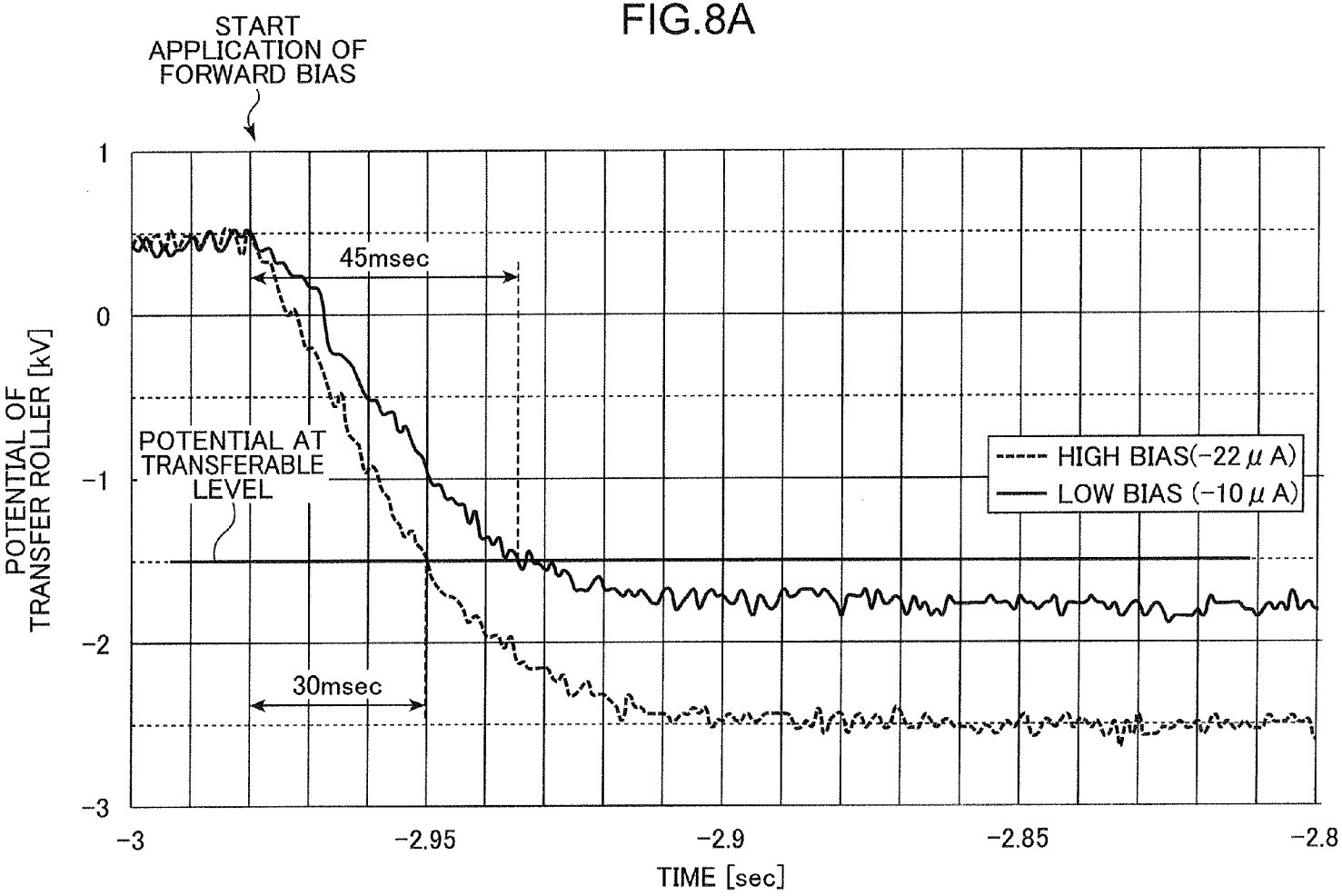
FIGS. 8A and 8B are diagrams showing rising times of a transfer bias current.

FIG. 8A is a diagram showing actual changes of the transfer biases. In FIG. 8, the horizontal axis represents time and the vertical axis represents potentials of the transfer roller 46. As shown in the diagram, when a transfer bias current at a high bias level of −22 μA is applied to the transfer roller 46, it takes the potential of the transfer roller 46 approximately 30 msec (rising time of the transfer bias current) to reach −1.5 KV, which is a transferable level. On the other hand, when a transfer bias current at a low bias level of −10 μA is applied to the transfer roller 46, it takes the potential of the transfer roller 46 approximately 45 msec to reach the transferable level of −1.5 KV. In this manner, the rising times of the transfer bias current greatly vary depending on whether the transfer bias current is set at a high bias level or a low bias level.

Figure 8B:
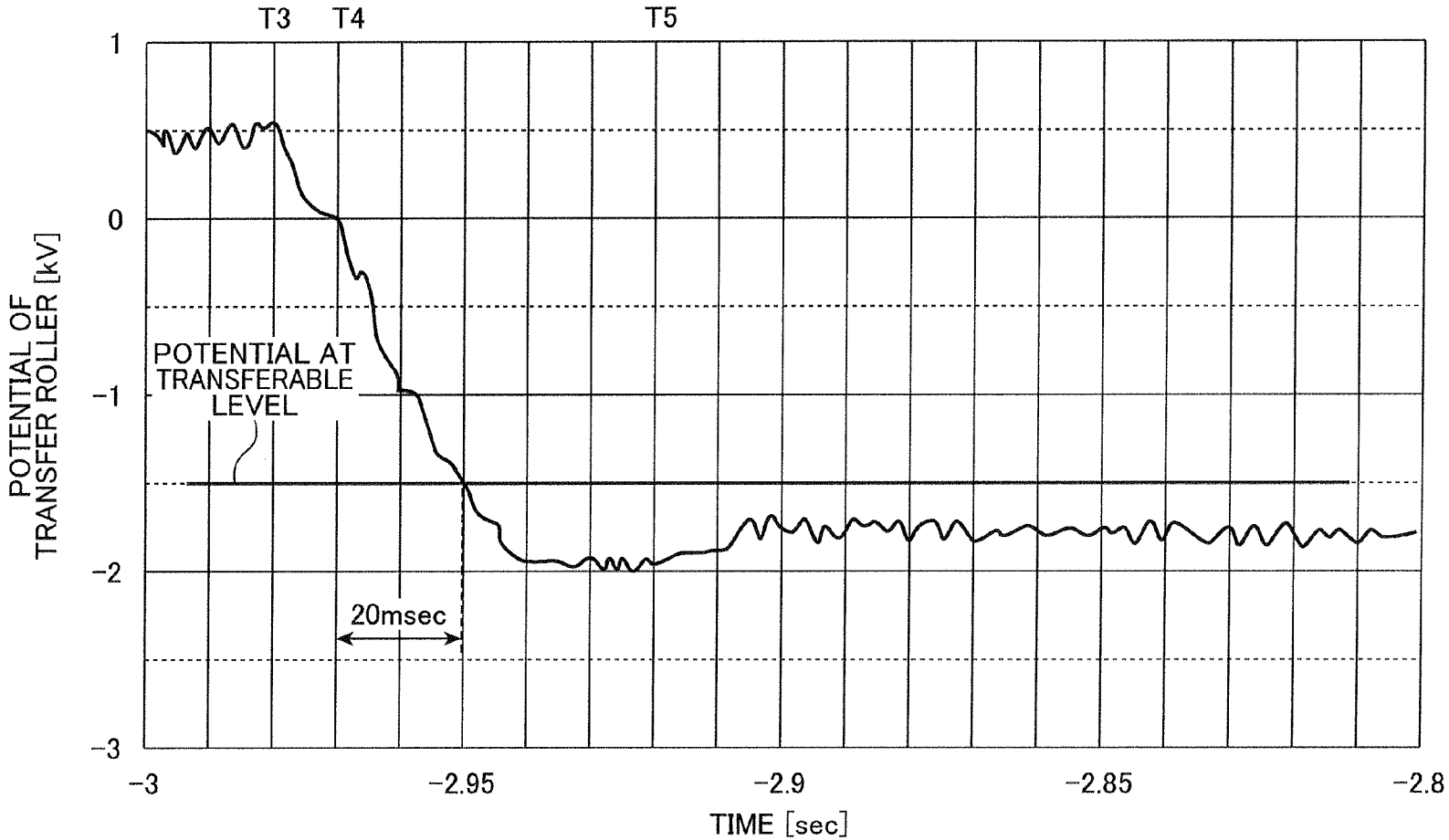

FIG. 8B is a diagram showing an example of sequence control of the transfer bias current that is performed in the vicinity of the leading end of the sheet in the present invention. The horizontal axis of FIG. 8B represents the lapses of time and the vertical axis represents potentials of the transfer roller 46. The reverse bias current is applied to the transfer roller 46 at a time point shown on the extreme left of the diagram. The application of the reverse bias current is stopped at T3, which is when the leading end of the sheet P reaches the nip part N. The potential of the transfer roller 46 becomes zero by T4 at which the first region of the sheet P passes through the nip part N. Next, the first forward bias current (−15 μA) is applied starting from the time point T4. Due to the application of the first forward bias, the potential of the transfer roller 46 reaches the transferable level of −1.5 KV in approximately 20 msec. Then, the potential of the transfer roller 46 reaches a stable potential in approximately 50 msec after being applied with the forward bias current. Therefore, at T5, 50 msec after T4, the first forward bias is switched to the second forward bias (−10 μA). The leading end of the third region passes through the nip part N at T5. The time point T5 can be appropriately set at a timing elapsing 20 msec from T4.

When the rising times of the transfer bias current increase, it becomes difficult to increase the potential of the transfer roller 46 to the transferable level when the transfer region TR of the sheet P passes through the nip part N. Specifically, in the examples of sequence control shown in FIGS. 5 and 8B, the second forward bias current is set at −10 μA in accordance with a state condition. When the biases applied to the transfer roller 46 are set uniformly to −10 μA in accordance with the state condition when the second region and the third region pass through the nip part N, the potential of the transfer roller 46 cannot be increased to the transferable level while the conveying direction leading end part of the second region of the sheet P passes through the nip part N. As a result, the toner image cannot be transferred appropriately in a predetermined section of the second region, possibly causing an image defect.

In the present embodiment, however, the first forward bias current is set at −15 μA, in order to increase the potential of the transfer roller 46 to the transferable level while the conveying direction leading end part of the second region of the sheet P passes through the nip part N. Therefore, the toner image is appropriately transferred in the second region. As a result, the generation of an image defect is inhibited.

Figure 9B:
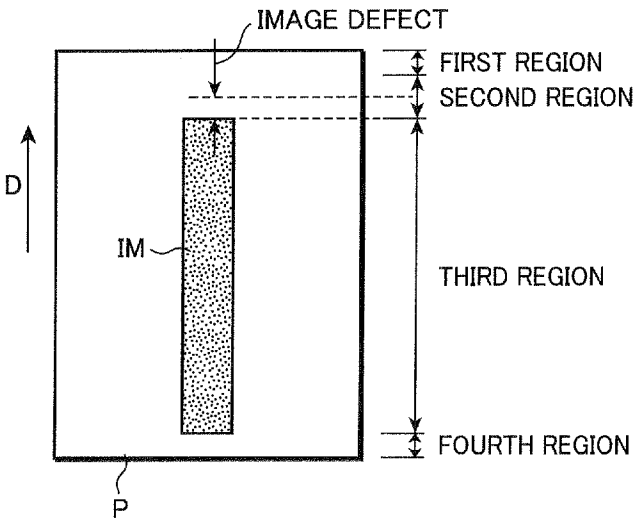
FIG. 9B shows the result obtained when a first forward bias current of −10 μA is applied to the transfer roller as the second region of the sheet begins to pass through the nip part.
Figure 9A:
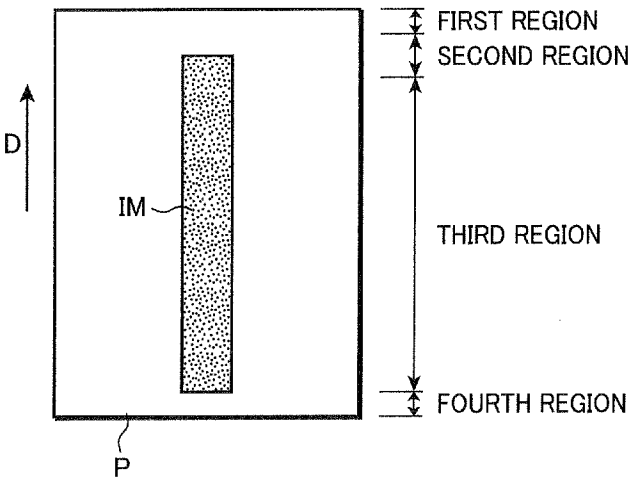
FIG. 9A shows the result obtained when a first forward bias current of −15 μA is applied to the transfer roller as a second region of the sheet begins to pass through the nip part.

FIG. 9 shows an experiment for confirming whether an image defect is generated or not when a strip-shaped toner image IM extending along the conveying direction of the sheet P is formed on the sheet P, wherein FIG. 9A shows the result obtained when a first forward bias current of −15 μA is applied to the transfer roller 46 as the conveying direction leading end part of the second region of the sheet P begins to pass through the nip part N, and FIG. 9B shows the result obtained when a first forward bias current of −10 μA is applied to the transfer roller 46 as the conveying direction leading end part of the second region of the sheet P begins to pass through the nip part N.

In FIG. 9A where the first forward bias current was set at −15 μA, the potential of the transfer roller 46 could be increased to the transferable level when the conveying direction leading end part of the second region of the sheet P began to pass through the nip part N. Therefore, no image defects were generated on the toner image IM in a predetermined section of the second region.

In FIG. 9B where the first forward bias current was set at −10 μA, on the other hand, the potential of the transfer roller 46 could not be increased to the transferable level when the conveying direction leading end part of the second region of the sheet P began to pass through the nip part N. As a result, an image defect was generated on the toner image IM in the predetermined section of the second region.

Figure 10:
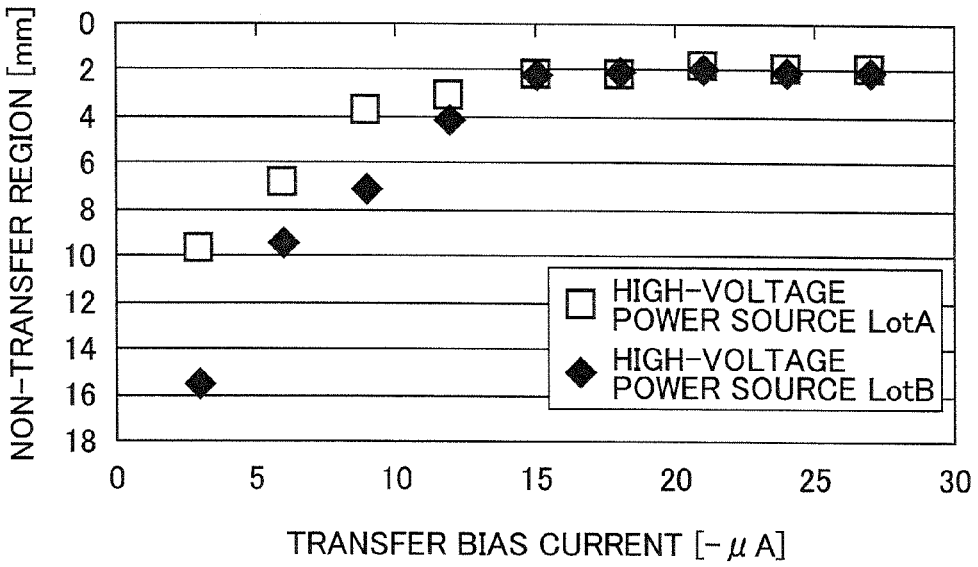
FIG. 10 is a diagram related to a rising performance of the transfer bias current and showing a difference in rising performance between high-voltage power sources of different Lots.

Moreover, the rising times of the transfer bias current tend to fluctuate due to not only the differences in bias levels but also a difference in rising performance between high-voltage power sources configuring the transfer application unit 53. FIG. 10 relates to the rising performances of the high-voltage power sources, and shows a difference in performance between a high-voltage power source of LotA and a high-voltage power source of LotB. In FIG. 10, the horizontal axis represents the transfer bias current and the vertical axis represents the width of a non-transfer region viewed from the edge section on the conveying direction leading end side of the sheet P, the width being a distance along the conveying direction D of the sheet P in which the toner image is not transferred.

As shown in FIG. 10, when the transfer bias current is less than −15 μA, the width of the non-transfer region is great in both of the high-voltage power sources of LotA and LotB especially as the transfer bias current decreases. In addition, the width of the non-transfer region fluctuates significantly between the high-voltage power source of LotA and the high-voltage power source of LotB.

When, on the other hand, the transfer bias current is −15 μA or above, the width of the non-transfer region is as small as approximately 2 mm in both of the high-voltage power sources of LotA and LotB. In addition, there are no fluctuations in the width of the non-transfer region between the high-voltage power source of LotA and the high-voltage power source of LotB. Therefore, when the forward bias currents are −15 μA or above, the time required for the potential of the transfer roller 46 to reach the transferable potential becomes constant.

Based on the results shown in FIG. 10, in the present embodiment the first forward bias current is set at −15 μA. As described above, by setting the first forward bias current at −15 μA, the potential of the transfer roller 46 can be increased to the transferable level while the second region of the sheet P passes through the nip part N.

As described above, in the present embodiment, the first forward bias current is determined after taking into consideration a delay of a rising time of the transfer bias current, which is caused by a level difference of the transfer bias current, as well as a difference in rising performance between the high-voltage power sources configuring the transfer application unit 53. In this manner, the generation of an image defect in the toner image is prevented, and at the same time the separability of the sheet P from the drum surface 16 is improved.

This application is based on Japanese Patent Application Serial No. 2010-244434 filed in Japan Patent Office on Oct. 29, 2010, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus, comprising:

a photosensitive drum that has a drum surface on which a toner image is formed;

a transfer member that forms, with the drum surface, a nip part through which a sheet passes while conveyed, and sequentially transfers onto the sheet in the nip part the toner image on the drum surface from a conveying direction leading end side of the sheet;

a first application unit that selectively applies to the transfer member a fixed first forward bias, a variable second forward bias, and a reverse bias having a polarity opposite to polarities of the first forward bias and the second forward bias;

a second application unit that applies to the drum surface a drum bias having a polarity opposite to polarities of the first and second forward biases; and a bias controller that controls the first application unit and the second application unit, and has a state acquiring unit for acquiring state information and a setting unit for setting the second forward bias in accordance with the state information, wherein the bias controller, while controlling the second application unit to apply the drum bias to the drum surface, first, controls the first application unit to apply the reverse bias or no bias to the transfer member, when a first region, which is located in a conveying direction at a farthest leading end of the sheet and to which the toner image is not transferred, passes through the nip part, then controls the first application unit to apply the first forward bias to the transfer member when a conveying direction leading end part of a second region begins to pass through the nip part, this second region being a region which is located on a rear end side of the first region in a conveying direction of the sheet and to which the toner image is transferred, and then controls the first application unit to apply the second forward bias to the transfer member when a third region, which is located on a further rear end side than the second region in the conveying direction of the sheet and to which the toner image is transferred, passes through the nip part, and wherein the first forward bias is set at a predetermined value or above regardless of the state information, and increases a potential of the transfer member to a level at which the toner image is transferred in the second region when the second region passes through the nip part, and the second forward bias is set in accordance with the state information.

2. The image forming apparatus according to claim 1, further comprising:

a separating member that is disposed facing the drum surface, with a predetermined gap therebetween, at a position downstream of the nip part as viewed from the conveying direction of the sheet, wherein the separating member separates the sheet from the drum surface when the sheet passes through the nip part while attached to the drum surface.

3. The image forming apparatus according to claim 2, wherein a current of the first forward bias and a current of the second forward bias exhibit negative bias value, and a current of the reverse bias exhibits positive bias value.

4. The image forming apparatus according to claim 2, wherein the state information includes any of humidity, temperature, conveying speed of the sheet, or a type of the sheet.

5. The image forming apparatus according to claim 4, wherein when all of the state information items excluding the humidity are unchanged, the bias controller sets an absolute value of the current of the second forward bias at a value that increases as the humidity increases.

6. The image forming apparatus according to claim 4, wherein when all of the state information items excluding the conveying speed of the sheet are unchanged, the bias controller sets an absolute value of the current of the second forward bias at a value that increases as the conveying speed of the sheet increases.

* * * * *